US008861759B2

(12) United States Patent
Pape et al.

(10) Patent No.: US 8,861,759 B2
(45) Date of Patent: Oct. 14, 2014

(54) FEEDBACK SUPPRESSION DEVICE AND METHOD FOR PERIODIC ADAPTATION OF A FEEDBACK SUPPRESSION DEVICE

(71) Applicant: Siemens Medical Instruments Pte. Ltd., Singapore (SG)

(72) Inventors: Sebastian Pape, Erlangen (DE); Tobias Wurzbacher, Fuerth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1 day.

(21) Appl. No.: 13/668,508

(22) Filed: Nov. 5, 2012

(65) Prior Publication Data

US 2013/0114837 A1 May 9, 2013

(30) Foreign Application Priority Data

Nov. 3, 2011 (DE) ..... 10 2011 085 668

(51) Int. Cl.
*H04R 25/00* (2006.01)
*H04R 3/02* (2006.01)

(52) U.S. Cl.
CPC ..... *H04R 25/453* (2013.01); *H04R 3/02* (2013.01)
USPC ..... 381/318; 381/312; 381/316; 381/317

(58) Field of Classification Search
USPC ..... 381/312, 316–318
See application file for complete search history.

(56) References Cited

U.S. PATENT DOCUMENTS

| | | | | |
|---|---|---|---|---|
| 6,418,227 | B1 | 7/2002 | Kuo | |
| 7,813,497 | B2 * | 10/2010 | Brox | 379/406.08 |
| 8,170,248 | B2 * | 5/2012 | Hersbach et al. | 381/318 |
| 8,477,952 | B2 * | 7/2013 | Elmedyb et al. | 381/23.1 |
| 8,571,244 | B2 * | 10/2013 | Salvetti | 381/318 |
| 2006/0008076 | A1 | 1/2006 | Okumura et al. | |
| 2007/0258579 | A1 | 11/2007 | Hirai et al. | |
| 2007/0297627 | A1 | 12/2007 | Puder | |
| 2008/0279395 | A1 | 11/2008 | Hersbach et al. | |
| 2009/0196445 | A1 | 8/2009 | Elmedyb et al. | |
| 2010/0260365 | A1 * | 10/2010 | Petrausch | 381/318 |
| 2011/0164762 | A1 | 7/2011 | Oouchi et al. | |
| 2011/0194714 | A1 | 8/2011 | Puder | |

FOREIGN PATENT DOCUMENTS

| | | | |
|---|---|---|---|
| DE | 10 2006 029 194 | A1 | 12/2007 |
| DE | 10 2010 006 154 | A1 | 8/2011 |

OTHER PUBLICATIONS

Waterschoot, T., et al., "Fifty Years of Acoustic Feedback Control: State of the Art and Future Challenges", Proceedings of the IEEE, Feb. 2011, pp. 288-327, vol. 99, Issue 2, URL: ftp://ftp.esat.kuleuven.be/pub/sista/vanwaterschoot/reports/08-13.pdf.

* cited by examiner

*Primary Examiner* — Curtis Kuntz
*Assistant Examiner* — Ryan Robinson
(74) *Attorney, Agent, or Firm* — Laurence A. Greenberg; Werner H. Sterner; Ralph E. Locher

(57) ABSTRACT

A method is provided for adapting a feedback suppression device of a hearing device to a given situation in order to improve the quality of feedback suppression in hearing devices and in hearing aids in particular. In the method an adaptation procedure of the feedback suppression device is periodically activated and adaptation of the feedback suppression device is performed regularly even if a feedback detector does not detect a feedback situation. A feedback suppression device for a hearing device is also provided.

6 Claims, 4 Drawing Sheets

FEEDBACK SUPPRESSION DEVICE AND METHOD FOR PERIODIC ADAPTATION OF A FEEDBACK SUPPRESSION DEVICE

CROSS-REFERENCE TO RELATED APPLICATION

This application claims the priority, under 35 U.S.C. §119, of German Patent Application DE 10 2011 085 668.4, filed Nov. 3, 2011; the prior application is herewith incorporated by reference in its entirety.

BACKGROUND OF THE INVENTION

Field of the Invention

The present invention relates to a method for adapting a feedback suppression device of a hearing device to a given situation by activating an adaptation procedure of the feedback suppression device and performing the adaptation procedure of the feedback suppression device. The present invention further relates to a corresponding feedback suppression device. The term hearing device is understood in this context to mean an instrument, in particular a hearing aid, a headset, headphone and the like, that can be worn in or on the ear and triggers a hearing stimulus.

Hearing aids are portable hearing devices that provide support for people who are hard of hearing. In order to accommodate the numerous individual needs, various structural formats of hearing aids are available, such as behind-the-ear (BTE) hearing aids, hearing aids with an external earphone (RIC: receiver in the canal) and in-the-ear hearing aids (ITE), e.g. including concha hearing aids or canal hearing aids (ITE, CIC). The hearing aids cited by way of example are worn on the outer ear or in the auditory canal. Bone conduction hearing aids, implantable or vibrotactile hearing aids are also available. The stimulation of the damaged hearing is either mechanical or electrical in that case.

Hearing aids generally include an input converter, an amplifier and an output converter as main components. The input converter is usually a sound receiver, e.g. a microphone, and/or an electromagnetic receiver, e.g. an induction coil. The output converter is normally embodied as an electroacoustic converter, e.g. miniature loudspeaker, or as an electromagnetic converter, e.g. bone conduction headphone. The amplifier is usually integrated in a signal processing unit. That basic structure is illustrated in FIG. 1 with reference to the example of a behind-the-ear hearing aid. One or more microphones 2 for receiving the sound from the environment are incorporated in a hearing aid housing 1 that is worn behind the ear. A signal processing unit 3, which is likewise integrated in the hearing aid housing 1, processes and amplifies the microphone signals. An output signal of the signal processing unit 3 is transferred to a loudspeaker or earphone 4, which outputs an acoustic signal. The sound is optionally transferred to the eardrum of the instrument wearer through a sound tube that is fixed in the auditory canal through the use of a molded earpiece. The energy supply of the hearing aid and in particular that of the signal processing unit 3 is provided through the use of a battery 5 that is likewise integrated in the hearing aid housing 1.

The present invention can be used not only for hearing devices, but also generally for audio systems including at least a microphone for picking up sound from the environment, subsequent signal processing (e.g. amplification) of the microphone signal, and output of the processed signal into the environment through the use of a converter (e.g. loudspeaker). A hearing aid is one example of such an audio system.

So-called "feedback whistle" is a very unpleasant state of such an audio system. Specifically, acoustic feedback is known to occur when the sound that is emitted by the converter re-enters the audio system through the microphone and is amplified again there. A closed loop is produced in that case (microphone→amplification→converter→microphone, etc.), and feedback whistle occurs when the amplification exceeds a certain threshold value.

The unwanted whistle can be reduced or even eliminated through the use of a feedback suppression device. In the case of known feedback suppression systems, an adaptive filter models the temporally variant impulse response g of the acoustic feedback path. A common example of an adaptation rule for updating filter coefficients h is a normalized NLMS algorithm (normalized least mean squares): $h(k+1)=h(k)+\mu[(e^*(k)x(k))/(x^*(k)x(k))]$.

In that equation, k represents the discrete time index, x represents the input signal of the feedback suppression system, $e=m-c$ represents an error signal that is defined by the difference between the microphone signal m and the feedback compensation signal c, μ represents the increment parameter for controlling the adaptation speed, and * represents a complex-conjugate operation. That is shown in a block diagram in FIG. 2. For the sake of simplicity, the time dependency (discrete time index k) is not shown. A desired signal s is picked up by a microphone 10. That results in the microphone signal m. A signal processing device 11 processes the signal further. A compensation signal c is subtracted from the microphone signal m, so that an error signal e is obtained. That error signal e is supplied to a main processing unit 12 (e.g. including a filter bank). The output signal x of the main processing unit 12 (SP) is supplied to both a converter (e.g. loudspeaker 13) and a feedback compensator 14. The feedback compensator 14 (FBC) and its specific interconnection together represent a feedback compensation device. It has a transfer function h, which serves as an estimated value for the acoustic path g from the loudspeaker 13 to the microphone 10. The feedback compensator 14 outputs a compensation signal $c=h*x$. The feedback compensator 14 is additionally controlled through the use of the error signal e.

The acoustic signal not only reaches the eardrum of the user, but it is also fed back over a feedback path 15 to the microphone 10 as indicated previously. The feedback path 15 has the cited transfer function g.

More detailed information can be found e.g. in a book by S. Haykin, entitled Adaptive Filter Theory, Prentice-Hall, Englewood Cliffs, N.J., 1996, and in an article by Toon van Waterschoot and Marc Moonen, entitled "Fifty Years of Acoustic Feedback Control State of the Art and Future Challenges", in Proc. IEEE, volume 99, No. 2, February 2011, pages 288-327.

The parameter μ is also referred to as an increment. That can be used to control the adaptation speed of a filter. Suitable time-dependent control of the increment μ is important for effective and stable feedback suppression. If μ is large, the filter quickly adapts to situation changes of the acoustic feedback path g, thereby preventing feedback whistle. However, if the increment is always too high, that can result in incorrect adaptation in relation to tonal signals (e.g. music).

There are various models for controlling the increment μ in a suitable manner. However, all of the models require compromises. Two known models are introduced in the following:

Estimating an Optimal Increment

By making a number of simplifications and assuming certain preconditions, a theoretical optimal increment μ is determined as follows: $\mu_{opt}\sim=E\{|c|^2\}/E\{|e|^2\}$, where E { } is the expected-value operator. The above formula helps stabilize the adaptation, but does not help solve the above problem of finding an increment that is suitable for preventing incorrect adaptations. In practice, the preconditions that are required in order to derive the above estimate are not actually met (e.g. the assumption of uncorrelated earphone and microphone signals and the assumption that the unknown acoustic feedback path has the transfer function g=0). Those deficiencies result in malfunctions.

b) Adaptation Triggered by Feedback Detector

In a normal mode, the adaptation is "frozen" by assigning a very low value to the increment μ. Adaptation is only allowed when the feedback detector becomes active, indicating a change of the acoustic feedback path (g). The necessity to re-adapt the feedback suppression filter using the transfer function h is therefore triggered by the temporal increase in the increment parameter μ. On one hand, the freezing of the adaptation guarantees stability (no incorrect adaptations for tonal excitation signals), provided the feedback detector is not accidentally activated. On the other hand, and this is a great disadvantage, the feedback suppression device only adapts when the feedback detector actually becomes active. In practice, it is often the case that the acoustic feedback path (g) changes only slightly (e.g. when passing through a door or sitting on a sofa). That does not usually result in feedback detection. Since no adaptation occurs, the momentary transfer function h of the feedback suppression system does not provide the current acoustic path (g), resulting in an audible harsher sound quality. The reduced sound acuity will continue until the feedback detector becomes active, which usually is accompanied by a feedback whistle. As a countermeasure, the sensitivity of the feedback detector could be adjusted in such a way that even slight changes of the acoustic path are recognized. However, that leads to a greater number of erroneous feedback detections and therefore more artifacts.

Both methods of controlling the increment μ can clearly be used together. A corresponding scenario is illustrated in FIG. 3. The block diagram shown is substantially based on that in FIG. 2. Reference is made to the preceding description in that respect. In addition to the system as per FIG. 2, a feedback detector 16 (FD) which picks up the microphone signal m, is integrated in the signal processing device 11. Its output signal is supplied to an increment control unit 17 (SWS), through the use of which the increment μ is controlled during the adaptation of the feedback compensator 14. Therefore, the increment μ is not controlled on the basis of the error signal e as in the example of FIG. 2. The feedback compensator 14 receives the error signal e as an additional input variable, as does the increment control unit 17. The latter receives the compensation signal c of the feedback capacitor 14 as a further input variable.

However, the user of such a feedback suppression system must live with a compromise. The user must either accept a harsh sound quality in the case of undetected path changes, or accept incorrect feedback detections and the risk of incorrect adaptations, resulting in tonal disruptions or other processing artifacts.

SUMMARY OF THE INVENTION

It is accordingly an object of the invention to provide a feedback suppression device and a method for periodic adaptation of a feedback suppression device, which overcome the hereinafore-mentioned disadvantages of the heretofore-known devices and methods of this general type and which reduce artifacts during an automatic adaptation of feedback suppression devices.

With the foregoing and other objects in view there is provided, in accordance with the invention, a method for adapting a feedback suppression device of a hearing device to a given situation. The method comprises activating an adaptation procedure of the feedback suppression device and performing the adaptation procedure of the feedback suppression device with the activation of the adaptation procedure taking place periodically.

With the objects of the invention in view, there is also provided a feedback suppression device for a hearing device. The feedback suppression device comprises an adaptation device for adapting the feedback suppression device to a given situation and an activation unit for activating the adaptation device, wherein the adaptation device can be activated periodically through the use of the activation device.

Therefore, the adaptation procedure of the feedback suppression device is advantageously activated periodically. It is therefore possible to ensure that adaptations of the feedback suppression system take place even in the case of minor path changes to which the feedback detector does not respond. The adaptation does not, however, always take place immediately, but at least within a foreseeable time period.

In accordance with another mode of the invention, in the context of the adaptation procedure, an adaptive filter is preferably adapted by using a variable increment. This allows the adaptation to be performed more or less quickly as required.

In accordance with a further mode of the invention, the activation of the adaptation procedure can take place as a result of an abrupt increase in the increment. The abrupt increase results in a brief maladjustment, whereby an immediate readjustment is initiated.

In accordance with an added mode of the invention, in parallel with or independently of the periodic activation, the adaptation procedure can also be activated by a feedback detector when it detects a feedback. In this way, adaptation can also take place during a predetermined trigger period if required.

In accordance with an additional mode of the invention, the activation can be effected by a periodic binary activation signal that represents an on-state (e.g. "high") and an off-state (e.g. "low"). In this case, the activation of the adaptation procedure can also be effected by the signal edge during a transition from "low" to "high."

In accordance with yet another mode of the invention, the on-state and the off-state can continue for different respective lengths of time. In other words, the binary activation signal does not have to be symmetrical with respect to the length of the on and off-states.

In accordance with yet a further mode of the invention, in a specific embodiment, the time duration of the on-state or the time duration between two temporally consecutive on-states can change as a function of a current hearing situation. In particular, a current hearing situation can be represented by a classification result of a classifier. The time duration of a "high" state and/or a "low" state can then be changed as a function thereof.

In accordance with yet an added mode of the invention, the activation of the adaptation procedure can also be effected through the use of a periodic activation signal that has more than two values, with the values being changed as a function of a current hearing situation. In other words, the activation signal can also have a plurality of states (a plurality of discrete states) or even a continuous profile. Therefore, so-called soft decisions can be used to initiate the adaptation procedure.

In accordance with a concomitant mode of the invention, the activation of the adaptation procedure of the feedback suppression device can start a frequency shift algorithm or a frequency compression algorithm. This allows the stability of the feedback suppression to be improved further.

Other features which are considered as characteristic for the invention are set forth in the appended claims.

Although the invention is illustrated and described herein as embodied in a feedback suppression device and a method for periodic adaptation of a feedback suppression device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Referring now to the figures of the drawings in detail, it is noted that the exemplary embodiments described in greater detail below represent preferred embodiments of the present invention.

The feedback suppression as described below can be used in any audio system and in particular any hearing device, but primarily also in hearing aids.

In the normal mode described in the introduction, the adaptation is frozen in the case of known systems, i.e. the increment μ for the adjustment is selected so as to be very small. According to the invention, it is now proposed that the increment μ be periodically set to a higher value or a predetermined high value. This increase of the increment irrespective of the local current acoustic situation results in a spontaneous readjustment of the feedback suppression. This means that the feedback suppression is switched from a frozen state into an adaptation state. This periodic triggering or initiation of the adaptation can be implemented in addition to or in parallel with existing increment control methods.

Figure 1:
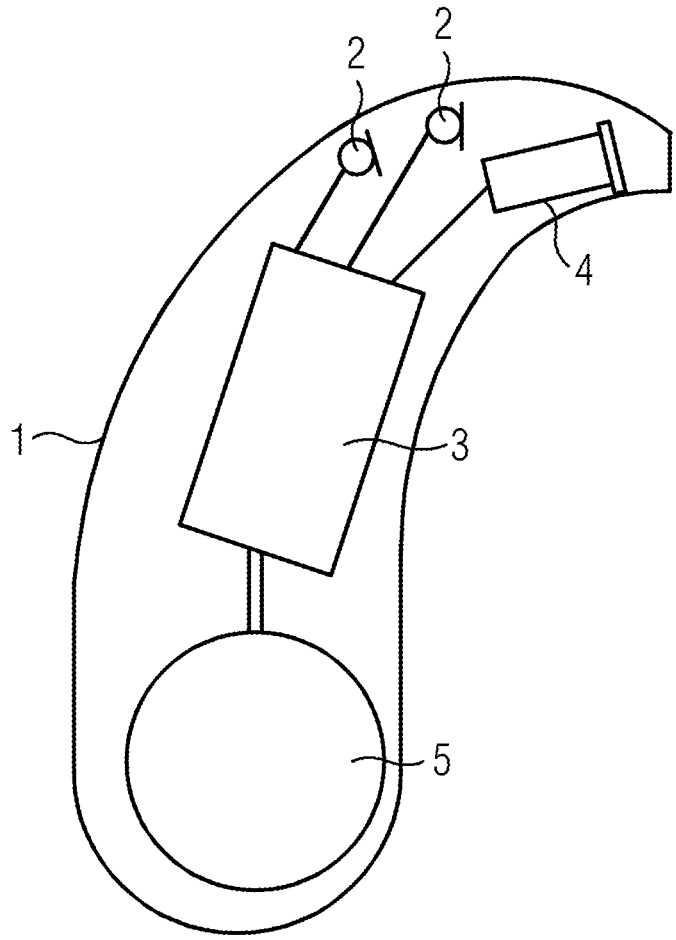
FIG 1 Prior Art
FIG. 1 is a diagrammatic, longitudinal-sectional view of a basic structure of a hearing aid according to the prior art.
Figure 2:
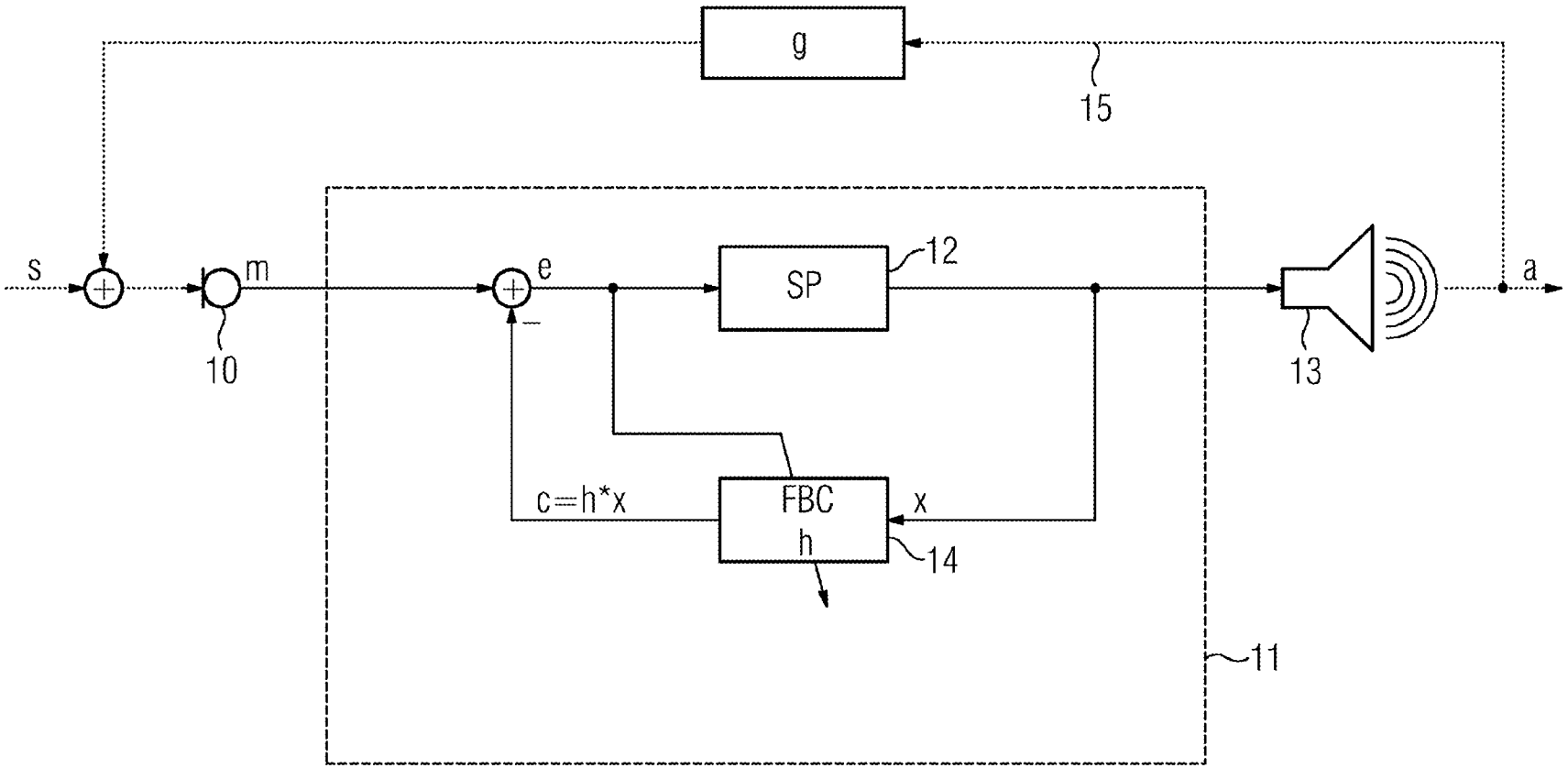
FIG 2 Prior Art
FIG. 2 is a block diagram of a simple feedback suppression circuit according to the prior art.
Figure 3:
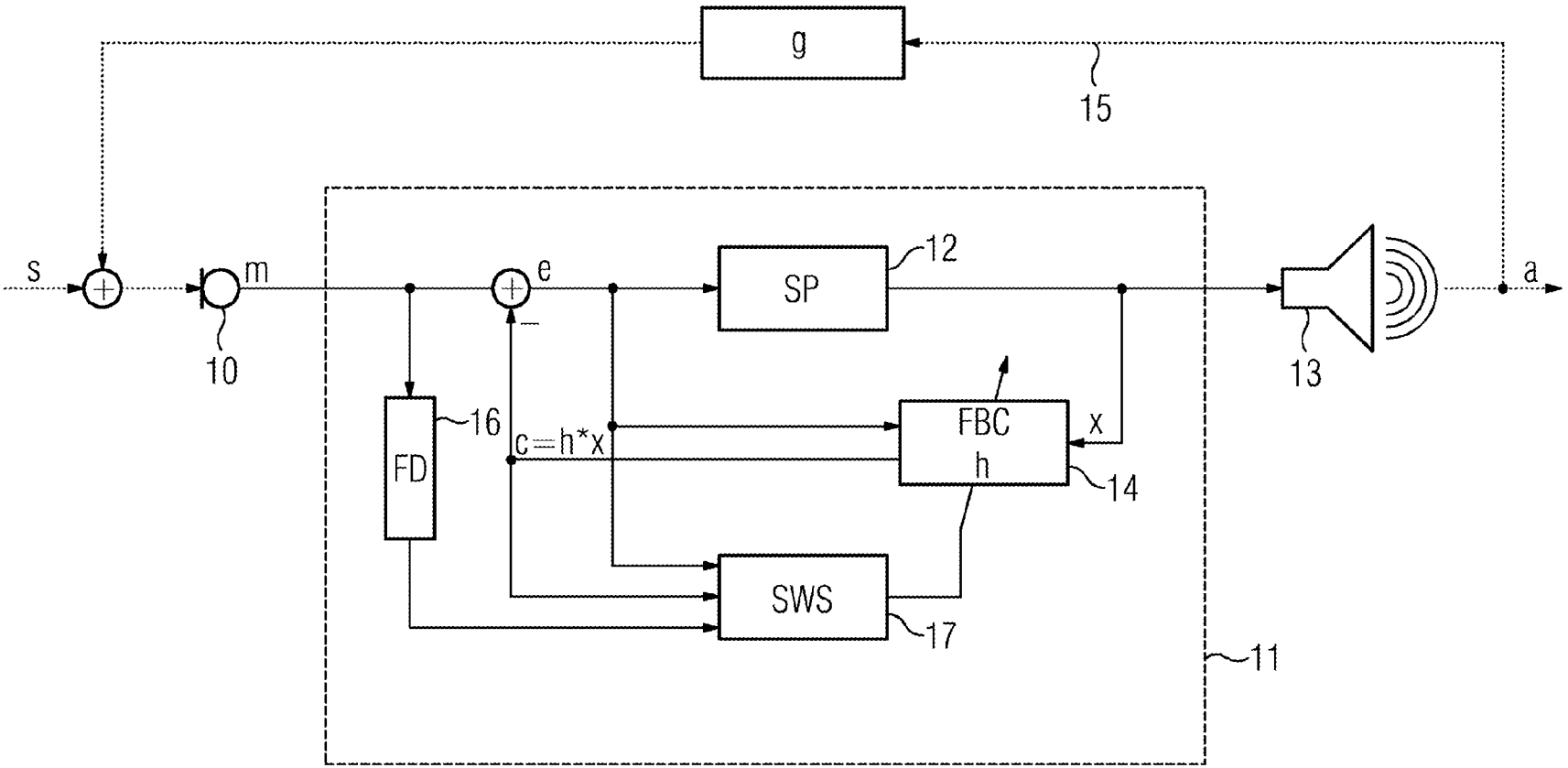
FIG 3 Prior Art
FIG. 3 is a block diagram of a feedback suppression circuit with increment control according to the prior art.
Figure 4:
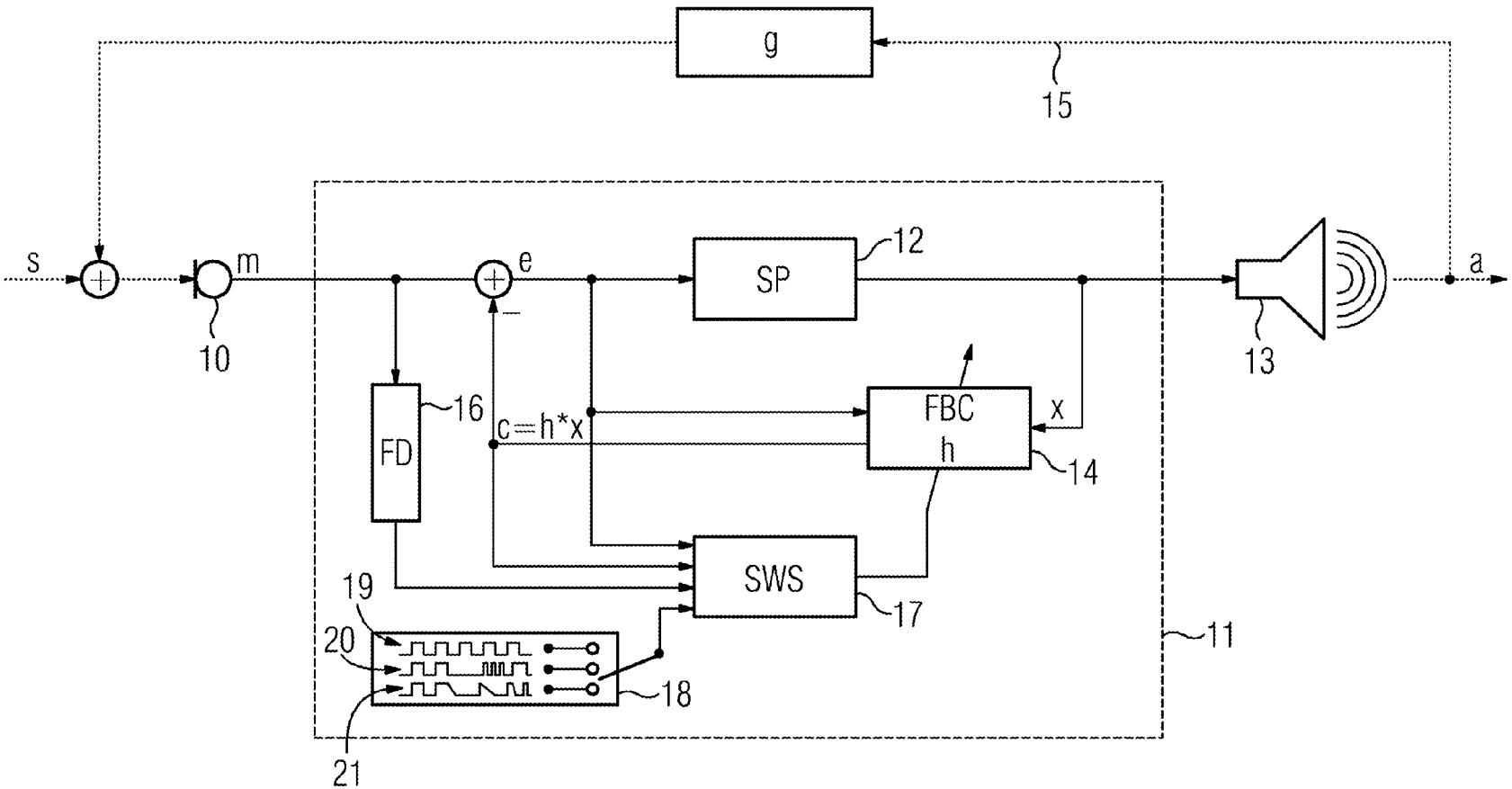
FIG. 4 is a block diagram of a feedback suppression circuit with periodic activation according to the present invention.

A schematic and block diagram of a system featuring a feedback suppression device according to the invention is depicted in FIG. 4. This figure also depicts corresponding method steps for adapting the feedback suppression. This is based on the system of FIG. 3. Reference is therefore made explicitly to the description of FIG. 2 and FIG. 3 in relation to the inventive system. Identical components in FIG. 3 and in FIG. 4 are denoted by the same reference signs and perform the same function, unless described otherwise.

FIG. 4 shows that an additional activation device 18 is included in the signal processing device 11 of the hearing device. Its output signal is supplied to the increment control unit 17. In the simplest case, the activation device 18 is constructed so as to provide a periodic binary signal 19 having an unchanged structure. This binary signal 19 has only two different states, namely an on-state (e.g. "high") and an off-state (e.g. "low"). As soon as the activation signal 19 is in the on-state, or at an edge from the off-state to the on-state, the increment μ in the increment control unit 17 is (abruptly) increased significantly for the feedback compensator 14.

The activation device 18 can also be constructed so as to generate other activation signals 20, 21. In this case, it can generate only one of these activation signals 19 to 21 or a plurality thereof.

The other activation signals are represented in this case by the activation signal 20, for which the signal period is variable, and the activation signal 21, which is not purely binary and can also assume intermediate values. The activation device 18 is optionally driven by other components of the signal processing device 11, in order to vary the output activation signal as a function of current signal processing variables. Such drive possibilities are not indicated in FIG. 4.

In a specific exemplary embodiment, if the activation signal (activation trigger) for the increment μ is e.g. "low" (off-state), the feedback suppression device remains in the frozen state. However, if the activation signal is "high" (on-state), the filter re-adapts the feedback suppression in such a way that an adjustment to the current acoustic feedback situation (g) is effected. If the periodic activation signal is in a "low" state and the feedback detector 16 becomes active, the increment μ is likewise adapted.

A number of possibilities for activating the adaptation of the feedback suppression or increasing the increment μ are described below.

The time duration of the "low" state and the time duration of the "high" state are either identical or different. For example, the activation signal can have the following structure: 1 second "low", 1 second "high", 1 second "low", 1 second "high", etc. According to another example, the activation signal has the structure: 5 seconds "low", 1 second "high", 5 seconds "low", 1 second "high", 5 seconds "low", etc.

The time duration between two consecutive "high" states (period duration) and the time duration of the "high" state itself can be either fixed or variable during operation. The variable time duration can be determined e.g. as a function of a decision of the feedback detector and/or as a function of a classification of the current hearing situation (with the activation signal 20).

The periodic activation signal can have only a "low" state and a "high" state, representing a hard decision between no adaptation and adaptation. However, the periodic activation signal can also be configured (with the activation signal 21) in such a way that a so-called soft decision is possible. In the case of a soft decision, the transition of the increment μ takes place continuously, thereby allowing a more flexible and situation-specific control of the adjustment speed.

It is possible to combine the periodic activation with other stability measures as part of the adaptation. For example, a frequency shift or frequency compression can be applied if the periodic trigger or activation signal is in the "high" state.

According to the invention, the increment control unit of the feedback suppression device is therefore triggered periodically. This means that the filter coefficients are renewed from time to time, thereby softening the frozen state to some extent. It is therefore not necessary for the feedback detector to track down a corresponding feedback result. This has the advantage that, for most of the time during typical use, the periodic activation signal can be kept in a "low" state, in such a way that the adaptation is frozen. This prevents the occurrence of any processing artifacts or maladjustment artifacts of the feedback suppression device.

In the case of minor changes to the acoustic path, known increment control units would not depart from the frozen state, resulting in a harsh metallic sound quality. That state would be maintained until a change of the acoustic path became so serious that a feedback detector took effect or until the hearing aid wearer personally provoked feedback by hand. It is only in that way that the situation of non-adjustment could be rectified. However, that meant that a feedback whistle was unavoidable in order to change the situation. By virtue of the inventive periodic activation of the adjustment procedure, the period for which the feedback suppression device remains in the uncomfortable state is automatically limited. In the case of a correspondingly short period of the activation signal, this uncomfortable state is finished before the wearer of the hearing device is even aware of the harsh sound quality. Moreover, the re-adaptation to the change of the acoustic path as a result of the periodic activation no longer causes an additional feedback whistle as it did before. The reduction in the rate of occurrence of feedback whistle therefore increases the level of comfort when a hearing device is worn, and the trust in a properly functioning instrument.

The invention claimed is:

1. A method for adapting a feedback suppression device of a hearing device to a given situation, the method comprising the following steps:

activating an adaptation procedure of the feedback suppression device;

carrying out the adaptation procedure of the feedback suppression device;

carrying out the activation of the adaptation procedure periodically;

carrying out the activation with a periodic not purely binary activation signal having more than two values representing a plurality of states beyond an on-state and an off-state of the feedback suppression device;

and changing the values as a function of a current hearing situation.

2. The method according to claim 1, which further comprises adapting an adaptive filter having a variable increment, during the adaptation procedure.

3. The method according to claim 2, which further comprises carrying out the activation by increasing the increment abruptly.

4. The method according to claim 1, which further comprises, in addition to the periodic activation of the adaptation procedure, activating the adaptation procedure by a feedback detector if the feedback detector detects feedback.

5. The method according to claim 1, which further comprises causing a frequency shift algorithm or a frequency compression algorithm to start due to the activation of the adaptation procedure of the feedback suppression device.

6. A feedback suppression device for a hearing device, the feedback suppression device comprising:

an adaptation device for adapting the feedback suppression device to a given situation; and an activation device for activating said adaptation device, said activation device configured to periodically activate said adaptation device and to carry out the activation with a periodic not purely binary activation signal having more than two values representing a plurality of states beyond an on-state and an off-state of the feedback suppression device and to change the values as a function of a current hearing situation.

* * * * *